US006807936B1

(12) United States Patent
Burger et al.

(10) Patent No.: US 6,807,936 B1
(45) Date of Patent: Oct. 26, 2004

(54) OIL PRESSURE CONTROL VALVE BY SLIDING CAMSHAFT FOR AN INTERNAL COMBUSTION ENGINE

(75) Inventors: Wolf Burger, Boeblingen (DE); Eberhard Wizgall, Illingen (DE); Jan Schempp, Sinzing (DE); Reinhard Kasperbauer, Marbach (DE)

(73) Assignee: MTD Products Inc, Valley City, OH (US)

( * ) Notice: Subject to any disclaimer, the term of this patent is extended or adjusted under 35 U.S.C. 154(b) by 0 days.

(21) Appl. No.: 10/438,389

(22) Filed: May 15, 2003

(51) Int. Cl.[7] ..... F01M 1/00
(52) U.S. Cl. ..... 123/196 R
(58) Field of Search ..... 123/196 R

(56) References Cited

FOREIGN PATENT DOCUMENTS

| | | |
|---|---|---|
| DE | 844 370 | 10/1921 |
| DE | 342 068 | 5/1967 |
| DE | 1 241 191 | 2/2001 |
| DE | 199 38 285 A 1 | 5/2002 |

*Primary Examiner*—Noah P. Kamen
(74) *Attorney, Agent, or Firm*—Hessler & Vanderburg LLP

(57) ABSTRACT

The invention pertains to an internal combustion engine with a crankcase, a crankshaft and a camshaft for controlling at least one intake and exhaust valve, as well as an oil pump for delivering lubricating oil to the crankshaft. Downstream on the outlet side of the oil pump is an oil pressure regulating valve for limiting the oil pressure. The valve gate, which is contacted by a spring element in the closing direction, depending on the amount of oil delivered and/or the oil temperature, the valve gate frees an opening that can be connected with the inlet side of the oil pump. It is suggested that the camshaft be seated in longitudinally displaceable fashion within the crankcase and form the valve gate of the oil pressure control valve. An oil pressure-limiting valve for an internal combustion engine is thus implemented in a simple way.

6 Claims, 6 Drawing Sheets

OIL PRESSURE CONTROL VALVE BY SLIDING CAMSHAFT FOR AN INTERNAL COMBUSTION ENGINE

BACKGROUND OF THE INVENTION

A. Field of Invention

The invention pertains to internal combustion engines and more specifically to a device and methods for limiting the oil pressure generated by an oil pump.

B. Description of the Related Art

Use of oil pumps with a pressure control valve has long been commonly known in the art in internal combustion engines (see DE 12 41 191 A1). For this purpose, provided in the pressure line is a pressure control valve with a spring-loaded valve gate, which, at a predefined oil pressure, creates an opening or a connection to the inlet side of the pump.

Also commonly known in the art (see DE 85 17 900 U1) is the arranging of elements of an oil pump for an internal combustion engine on the camshaft that controls the intake and/or exhaust valves.

SUMMARY OF THE INVENTION

The purpose of the present invention is, specifically in the case of an internal combustion engine that is designed as a small engine, in a simple way to limit the oil pressure generated by the oil pump, whereby few additional components as possible are required for the implementation of the oil pressure valve.

The solution of the present invention is achieved through the features which will be described below. The internal combustion engine with the oil pressure limiting valve according to the invention is distinguished by a simple design in which a gradual shutoff flow from the oil pump back into the crankcase is possible in a reliable way by means of the camshaft, which is axially displaceable within the crankcase.

Additional advantageous developments and improvements of the internal combustion engine according to the invention are in the subclaims.

The oil pressure limiting function is achieved in a simple way, in that one face of the oil pump, which is designed as a rotor pump, is sealed off by a spring-loaded sealing washer, which, at a predefined oil pressure generated by the oil pump, opens a defined leakage gap, through which a flow of oil can flow back to the inlet side of the oil pump in order to limit the maximum oil pressure.

Provided between a bearing seat for a bearing journal of the camshaft and a limit stop provided on the camshaft is a spring element that presses the sealing washer against the face of the rotor pump. The side area of one of the cams that controls the intake or exhaust valve can advantageously be provided as the limit stop for the spring element.

The sealing washer for the oil pump is advantageously slipped onto the inner rotor, and lies against a driving gearwheel arranged on the camshaft.

The device itself is made up of few components; for example, the inner rotor of the oil pump is joined with the driving gearwheel for the camshaft as one piece.

An embodiment of the invention is explained in more detail in the following description and drawings.

BRIEF DESCRIPTION ON THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
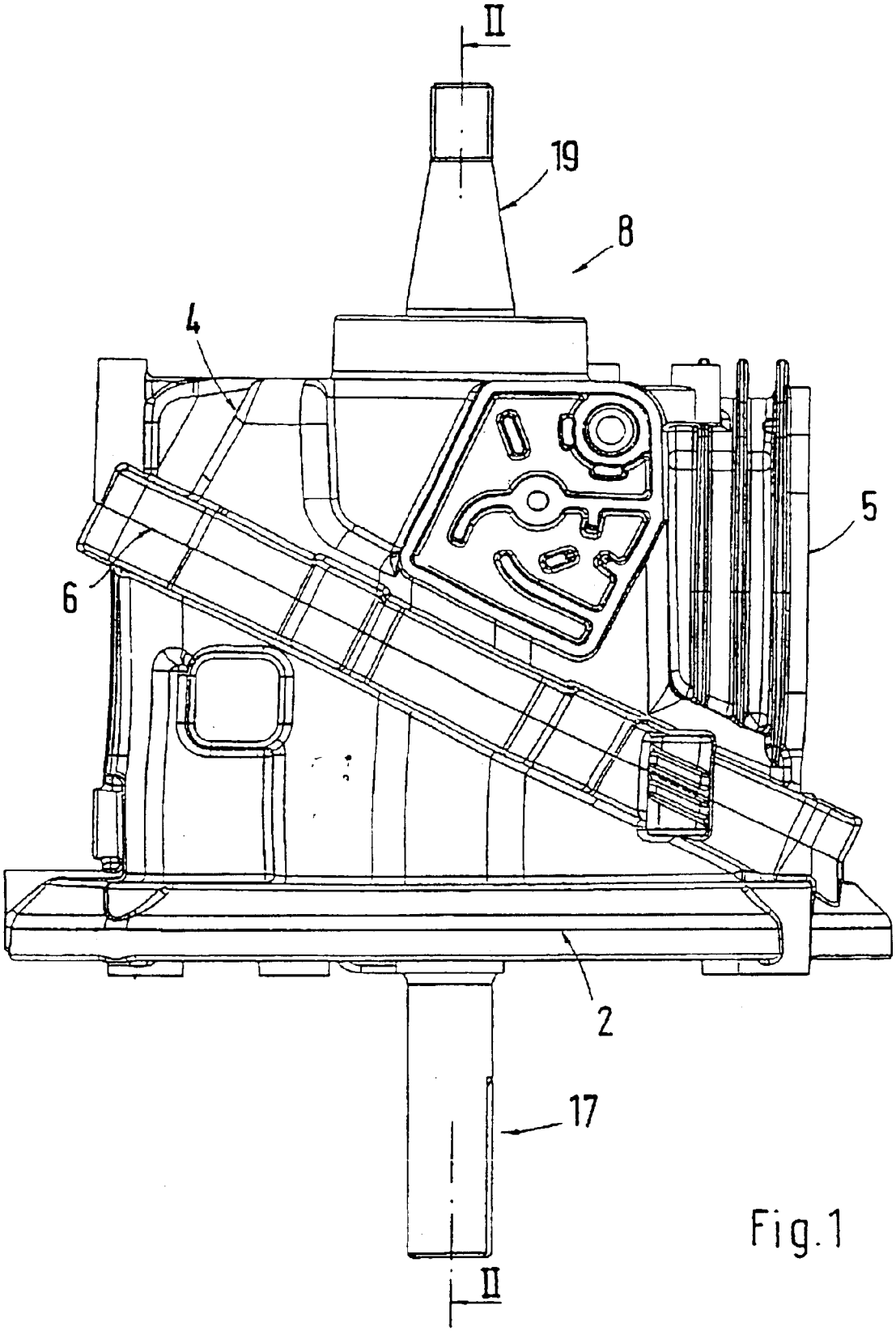
FIG. 1 shows a crankcase of a single-cylinder internal combustion engine.
Figure 2:
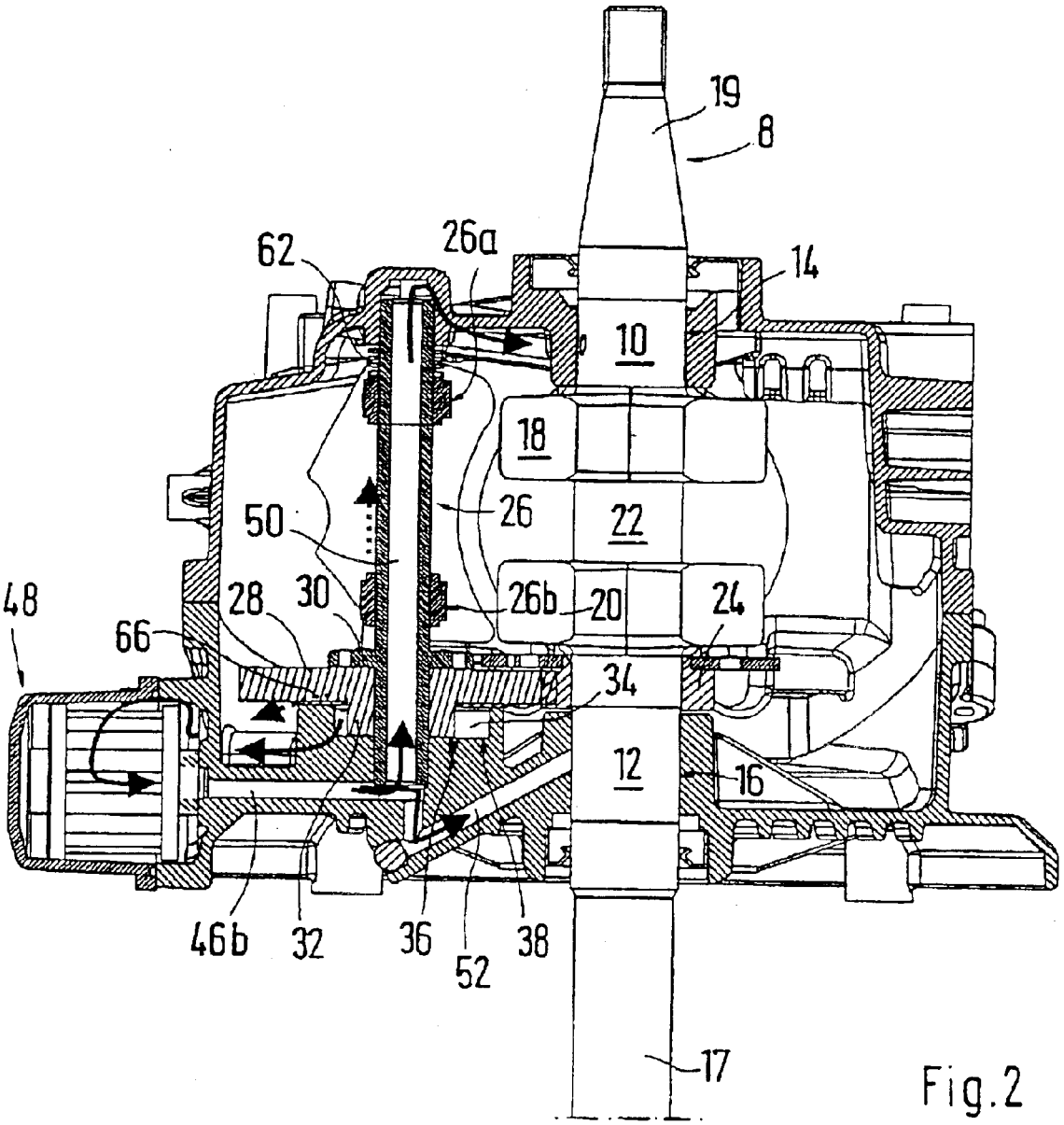
FIG. 2 shows a section along the line II—II of FIG. 1.
Figure 3:
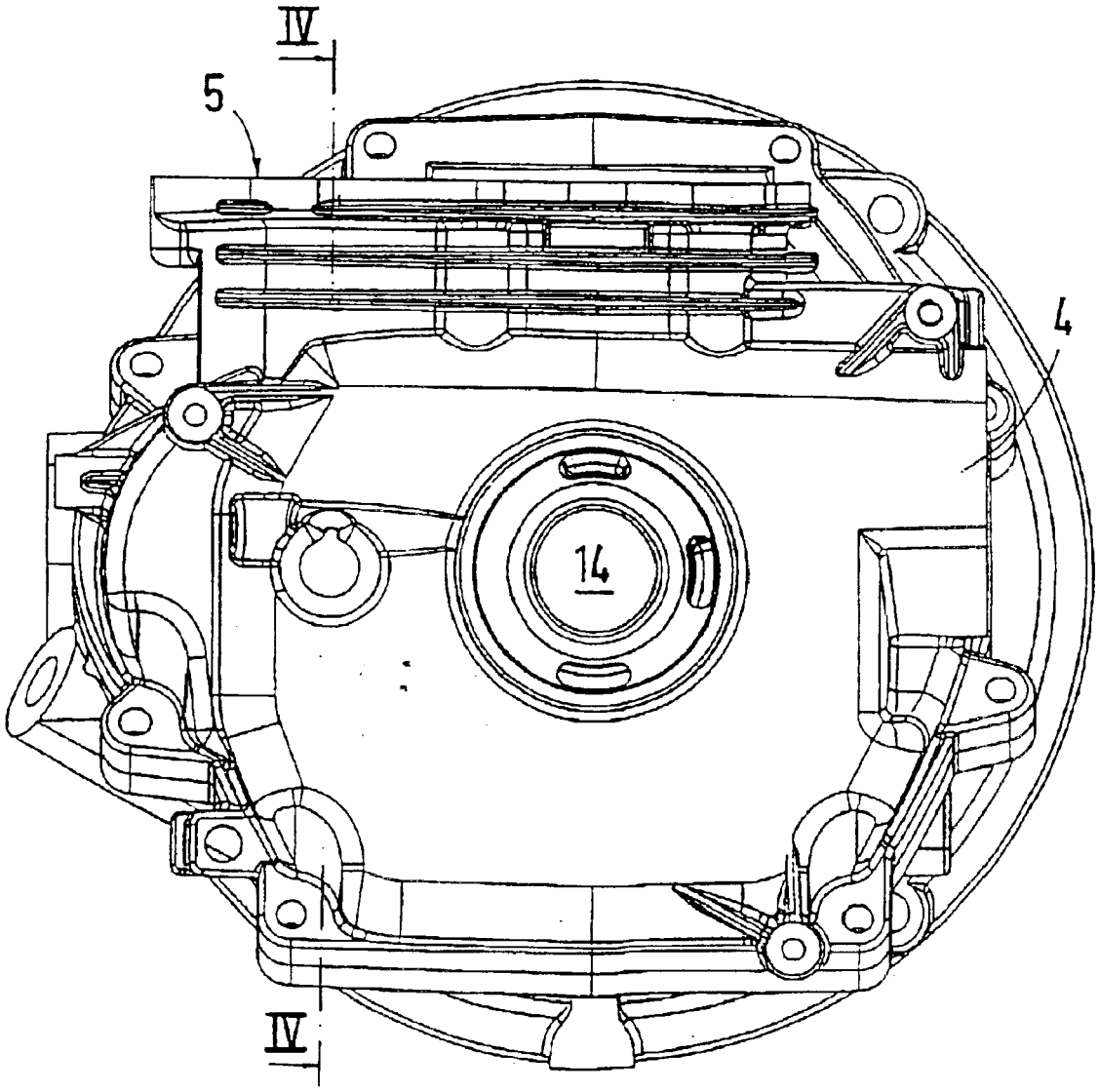
FIG. 3 shows a top view of the crankcase.
Figure 4:
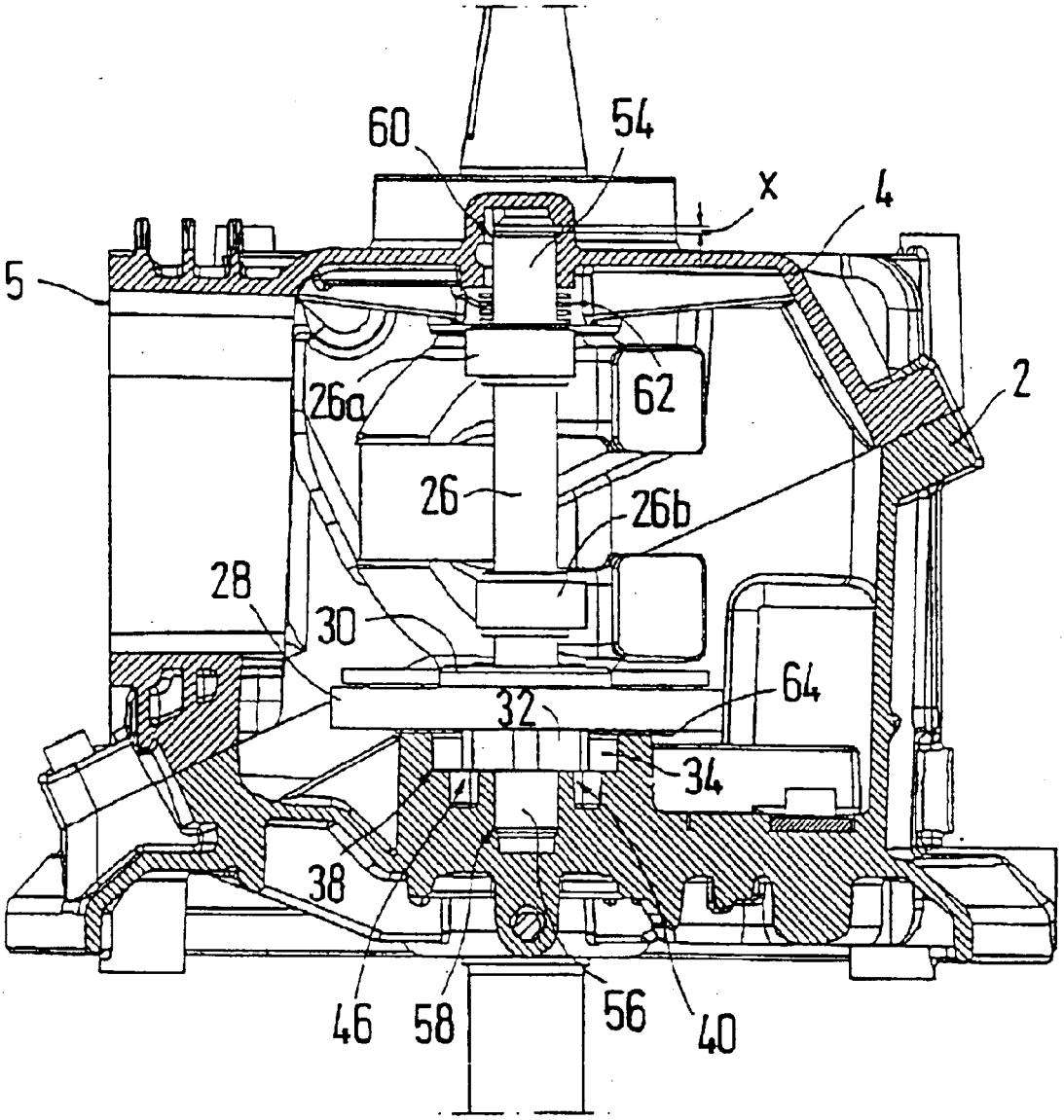
FIG. 4 shows a section along the line IV—IV of FIG. 3.

Referring now to the drawings wherein the showings are for purposes of illustrating a preferred embodiment of the invention only and not for purposes of limiting the same, FIGS. 1 and 2 show a crankcase of an internal combustion engine designed as a four-stroke single-cylinder engine and is comprised of two crankcase halves that are designated in the following as crankcase lower part 2 and crankcase upper part 4. Also visible on the crankcase upper part 4 is a cylinder flange 5 to which the engine's cylinder (not shown) is fastened. Arranged in the crankcase, which is provided with a diagonal dividing plane 6, is a crankshaft 8 that is carried on two shaft journals 10 and 12 inside the crankcase (cf. main bearings 14 and 16). The installed position of the engine depends on the application. In regards to a vertical arrangement of the crankshaft 8 as shown in FIGS. 1 and 2, the engine can be used in a lawnmower (not shown). For that application, a cutting blade (not shown) can be mounted on the lower shaft end 17 and a fanwheel (not shown) for cooling the engine can be mounted at the upper shaft end 19.

In addition, attached to the crankshaft 8 are two weights 18 and 20 for balancing the inertial forces, between which is located the crankshaft journal 22 for the connecting rod (not shown). Also, attached to the crankshaft 8 is a gearwheel 24 that actuates the camshaft 26 that is arranged parallel to the crankshaft 8. Provided for that purpose on the camshaft 26 is a driven gearwheel 28 that engages in intermeshing fashion with the gearwheel 24 via helical gearing. Arranged on the camshaft 26 are two cams 26*a* and 26*b* that serve to control intake and exhaust valves (not shown) that are arranged in the cylinder head, whereby the transmission of power takes place via suitable pushrods (not shown) and rocker arms (not shown).

The driven gearwheel 28 is formed of plastic and is slipped onto the camshaft 26 that is formed as a steel tube and is fixed in place axially by means of a limit stop 30 that is joined with the camshaft 26 as one piece. In addition, provided on the camshaft 26 is an externally toothed inner rotor 32, which is joined with the driven gearwheel 28 as one piece and which, together with an internally toothed outer rotor 34, forms an oil pump 36 for supplying the engine's lubricating oil. In that regard, the outer rotor 34 is seated in rotating fashion in an opening 38 in the lower part 2 of the crankcase. The oil pump is designed as a generally known positive-displacement pump in which the inner rotor 32 has one less tooth than the outer rotor 34.

Figure 5:
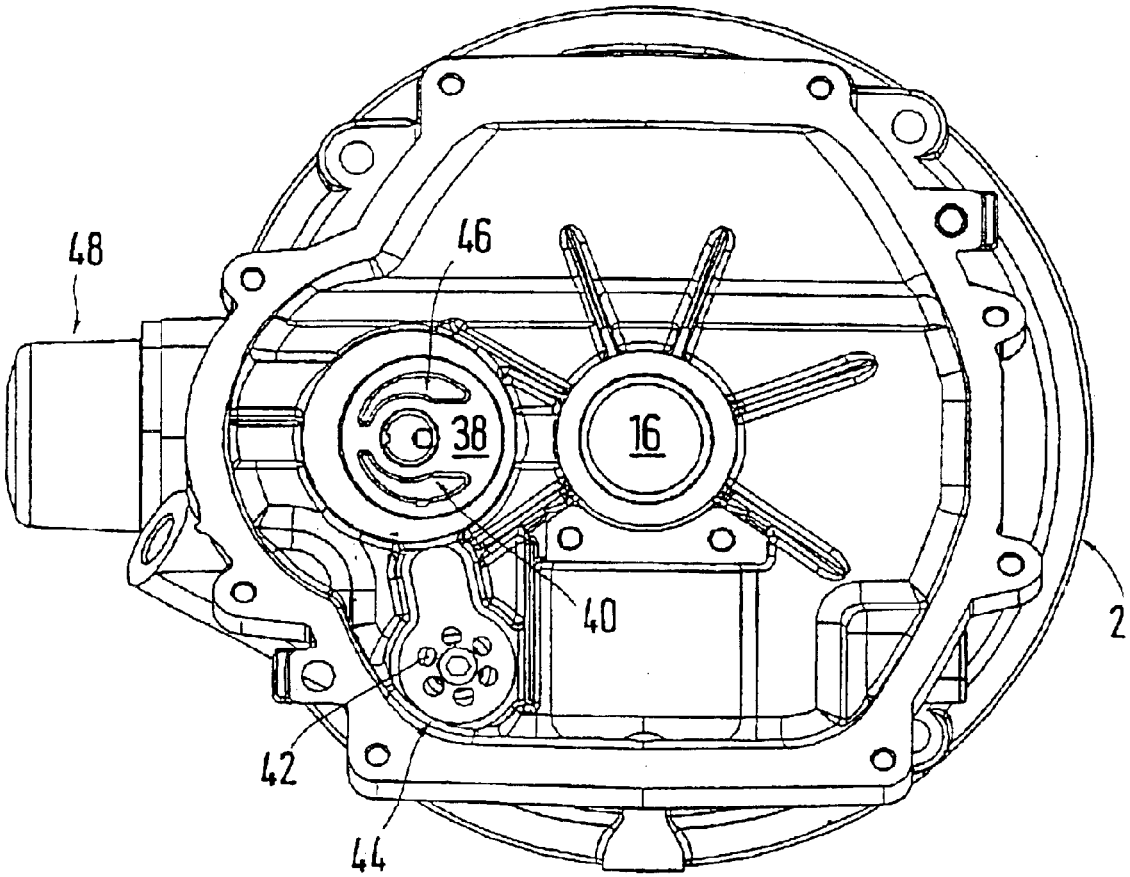
FIG. 5 shows an interior view of a crankcase half.
Figure 6:
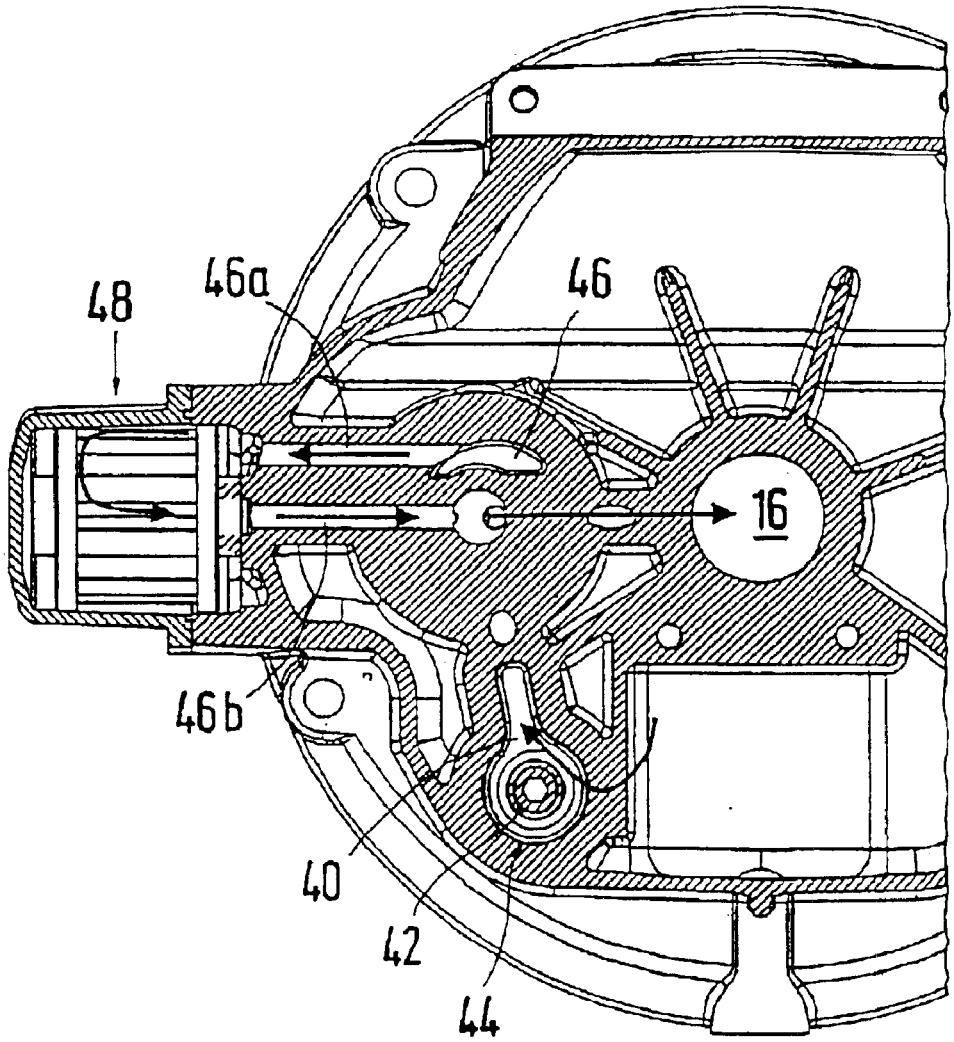
FIG. 6 shows a longitudinal section through a crankcase half in the region of the oil pump.

Referring to FIG. 5, joining into an opening 38 on the face is an intake channel 40 that is formed in a kidney shape at the mouth of the opening 38. The suction channel 40 leads to an oil suction location 44, which is provided with an oil screen 42 and through which the oil, as will be described in more detail later, is withdrawn for lubricating the consumers from an oil sump that forms in the lower half of the crankcase 2. In addition, provided in the opening 38 is a pressure oil channel 46, which is also formed in a kidney shape in the region of the mouth to the opening 38.

Referring to FIGS. 2 and 4–6, the pressure oil channel 46 leads through a feed section 46*a* to an oil filter 48, and from there through a return section 46*b* through a bore hole 50 provided in the camshaft 26 to the main bearing 14 provided in the upper part 4 of the crankcase, while an additional bore hole 52 provided in the lower half 2 of the crankcase that leads to main bearing 16. The camshaft 26 is carried by its two shaft journals 54 and 56 in two openings 58 and 60, which are formed as bearings in the crankcase lower and upper parts 2, 4, in such a way that it can be displaced axially by an amount x. In addition provided on the camshaft 26 is a spring assembly 62 that is fixed between a face of the cam 26*a* and crankcase wall surrounding the opening 60. In this regard, the spring assembly 62 is comprised of individual disk elements between which spring washers are arranged. Arranged on the inner rotor 32 of the oil pump 36 is a sealing washer 64, which on one side lies in sealing fashion against the face of the gearwheel 28, and on the other side against the crankcase lower part 2 housing wall that surrounds the opening 38, axially sealing the oil pump 36.

During operation, the engine draws oil through the oil pump 36, driven by the camshaft 26, from the oil sump that forms in the crankcase lower part 2, through the suction channel 40, and delivers it through the feed segment 46*a* of the pressure channel 46 to the oil filter 48, and from there through the return line 46*b*, on the one hand through the hollow bored camshaft 26 to the main bearing 14, and on the other, through the bore hole 52 to the main bearing 16 of the crankshaft 8. Among other things, the lubricating oil supply to the main bearings of the crankshaft 8 is thus assured.

If under certain operating conditions (among others, in dependency on oil temperature and engine rpm) the oil pressure forming in the individual chambers of the oil pump 36 becomes excessive, the camshaft 26 is displaced axially in the direction shown in FIG. 2 by the dotted arrow against the spring force of the spring assembly 62. When this occurs, forming between the sealing washer 64 and the housing wall against which the sealing washer 64 normally lies is a leakage gap through which the oil leakage flow 66 flows back into the oil sump of the lower part 2 of the crankcase to limit the maximum oil pressure.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. An internal combustion engine comprising:

a crankcase;

a crankshaft;

a camshaft for controlling at least one intake and exhaust valve;

an oil pump for delivering lubricating oil to the crankcase;

an oil pressure regulating valve located on the outlet side of the oil pump for limiting the oil pressure a valve gate contacted by a spring element in the closing direction;

wherein the valve gate frees an opening that can be connected with the inlet side of the oil pump depending on the amount of oil delivered and/or the oil temperature; and, wherein the camshaft is seated in longitudinally displaceable fashion within the crankcase and forms the valve gate of the oil pressure control valve.

2. The internal combustion engine of claim 1, wherein the oil pump is a rotor pump further comprising:

an inner rotor arranged on the camshaft an outer rotor seated in a recess of the crankcase wherein the oil pump is sealed on the face by a spring-loaded sealing washer.

3. The internal combustion engine of claim 2, wherein the spring element is fixed between a bearing seat for a shaft journal of the camshaft and a limit stop provided on the camshaft.

4. The internal combustion engine of claim 3, wherein the limit stop is formed by a cam of the camshaft.

5. The internal combustion engine of claim 4, wherein the sealing washer is slipped on the inner rotor of the oil pump and lies against a gearwheel arranged on the camshaft.

6. The internal combustion engine of claim 5, wherein the inner rotor of the oil pump is joined with the gearwheel as one piece.

* * * * *